US007121294B1

(12) United States Patent
Pierce

(10) Patent No.: US 7,121,294 B1
(45) Date of Patent: Oct. 17, 2006

(54) ROLL UP HOSE SYSTEM

(76) Inventor: Thomas G. Pierce, 11152 - 132nd Ave. North, Largo, FL (US) 33778

( * ) Notice: Subject to any disclaimer, the term of this patent is extended or adjusted under 35 U.S.C. 154(b) by 0 days.

(21) Appl. No.: 11/322,850

(22) Filed: Dec. 30, 2005

(51) Int. Cl.
*B65H 75/34* (2006.01)

(52) U.S. Cl. ..... 137/355.27; 137/355.26; 248/81; 248/84; 242/397

(58) Field of Classification Search ..... 137/355.26, 137/355.27; 248/81, 84; 242/397
See application file for complete search history.

(56) References Cited

U.S. PATENT DOCUMENTS 575,700 A * 1/1897 Charbonneau ..... 248/84
1,322,604 A * 11/1919 Nuhring ..... 137/355.18
1,444,900 A * 2/1923 Blaw ..... 248/84
1,814,342 A * 7/1931 Smith ..... 248/129
4,228,553 A * 10/1980 Genuit ..... 4/490
4,306,688 A * 12/1981 Hechler, IV ..... 242/397
4,543,982 A * 10/1985 Wolfe ..... 137/355.21

* cited by examiner

*Primary Examiner*—A. Michael Chambers
(74) *Attorney, Agent, or Firm*—Edward P. Dutkiewicz

(57) ABSTRACT

A core has ends with an exterior surface. The core is adapted to receive a hose. End plates are mounted with respect to the ends of the core for constraining a hose on the core. A crank is coupled to the core. The crank is adapted to be grasped by a user and rotated for coiling a hose onto the core. A squeezing assembly is formed of an upper roller and a lower roller. The squeezing assembly is mounted for vertical movement with springs. The springs urge the rollers toward each other. In this manner a hose passes between the rollers while being coiled up on the core and will have liquid removed there from.

2 Claims, 3 Drawing Sheets

ROLL UP HOSE SYSTEM

BACKGROUND OF THE INVENTION

1. Field of the Invention

The present invention relates to a roll up hose system and more particularly pertains to the coiling and uncoiling flat hose and for facilitating storage and deployment of the system.

2. Description of the Prior Art

The use of hose systems of known designs and configurations is known in the prior art. More specifically, hose systems of known designs and configurations previously devised and utilized for the purpose of storing a hose through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,388,716 issued Jun. 18, 1968 to Wilson relates to a Hose Reel. U.S. Pat. No. 4,228,553 issued Oct. 21, 1980 to Genuit relates to a Storage and Dispensing Apparatus for Swimming Pool Vacuum Hose. U.S. Pat. No. 4,543,9872 issued Oct. 1, 1985 to Wolf relates to an Automatic Rewinding Water Hose Reel. Lastly, U.S. Pat. No. 6,792,970 issued Sep. 21, 2004 to Lin relates to a Flat Water Hose Coiler.

While these devices fulfill their respective, particular objectives and requirements, the aforementioned patents do not describe a roll up hose system that allows the coiling and uncoiling flat hose and for facilitating storage and deployment of the system.

In this respect, the roll up hose system according to the present invention substantially departs from the conventional concepts and designs of the prior art, and in doing so provides an apparatus primarily developed for the purpose of coiling and uncoiling flat hose and for facilitating storage and deployment of the system.

Therefore, it can be appreciated that there exists a continuing need for a new and improved roll up hose system which can be used for coiling and uncoiling flat hose and for facilitating storage and deployment of the system. In this regard, the present invention substantially fulfills this need.

SUMMARY OF THE INVENTION

In view of the foregoing disadvantages inherent in the known types of hose systems of known designs and configurations now present in the prior art, the present invention provides an improved roll up hose system. As such, the general purpose of the present invention, which will be described subsequently in greater detail, is to provide a new and improved roll up hose system and method which has all the advantages of the prior art and none of the disadvantages.

To attain this, the present invention essentially comprises a roll up hose system. First provided is aplastic hose. The plastic hose has an interior end and an exterior end. The plastic hose has a fitting. The hose is adapted to take on a cylindrical cross sectional configuration during use. A liquid moves through the plastic hose. The hose is adapted to take on a flat configuration during non-use and storage. The plastic hose has a common circumference along its length.

A rotatable cylindrical core is provided. The cylindrical core has axial ends. The cylindrical core has an axial length provided between the axial ends. The cylindrical core has a cylindrical exterior surface. The exterior surface is adapted to receive thereon the interior end of the hose. In this manner the hose may be coiled around the cylindrical core and be dispensed from the cylindrical core by pulling the fitting. The cylindrical core has a cylindrical bore. The axial length of the cylindrical core is essentially equal to the circumference of the hose plus or minus 50 percent.

Provided next are circular end plates. The end plates are fixedly mounted with respect to the cylindrical core. In this manner the hose is constrained on the core. The exterior surface of the core has a diameter of between about 25 percent and 75 percent of the diameter of the end plates.

A crank is provided. The crank has a horizontal interior section. The interior section extends through the end plates. The interior section is further secured to the cylindrical core for concurrent rotation with respect to the end plates. The crank also has a horizontal exterior section. The exterior section is adapted to be grasped by a user and rotated. In this manner a hose is coiled onto the core. The crank also has an intermediate section. The intermediate section couples the interior section and the exterior section.

Provided next is a leg assembly. The leg assembly is formed of four similarly configured legs. Each leg has an upper end with an aperture. The aperture receives the interior section of the crank. The leg assembly is formed of two legs on each side of the cylindrical core and end plates. Each leg has a lower end with wheels. The wheels facilitate rolling movement of the system. The leg assembly also includes a cross piece. The cross piece is provided on each side of the cylindrical core. The cross pieces each have ends. The ends are pivotally attached to two legs. The leg assembly further includes a central pivot. The central pivot allows the legs to move between essentially parallel orientations for storage and extended orientations during use.

Further provided is a squeezing assembly. The squeezing assembly is formed of two support plates. The support plates extend radially outwardly from the end plates. The support plates are laterally offset from the central axis of the cylindrical core with vertically spaced rollers. The squeezing assembly is also formed with an upper roller and a lower roller. The rollers are rotatably received in the support plates. Each roller has a support shaft. The squeezing assembly also includes springs. The support shaft is supported in the support plates for vertical movement with the springs. In this manner the upper roller is urged downwardly and the lower roller upwardly. Further in this manner a hose passes between the rollers while being coiled up on the cylindrical core and remove liquid from the hose.

Provided last are handling components. The handling components include an aperture. The aperture is provided in an upper extent of the support plates. The aperture facilitates hanging the system during storage. The handling components include a cross bar. The cross bar is provided between the end plates immediately beneath the aperture. The cross bar facilitates handling the system during relocation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved roll up hose system which has all of the advantages of the prior art hose systems of known designs and configurations and none of the disadvantages.

It is another object of the present invention to provide a new and improved roll up hose system which may be easily and efficiently manufactured and marketed.

It is further object of the present invention to provide a new and improved roll up hose system which is of durable and reliable constructions.

An even further object of the present invention is to provide a new and improved roll up hose system which is susceptible of a low cost of manufacture with regard to both materials and labor, and which accordingly is then susceptible of low prices of sale to the consuming public, thereby making such roll up hose system economically available to the buying public.

Even still another object of the present invention is to provide a roll up hose system for coiling and uncoiling flat hose and for facilitating storage and deployment of the system.

Lastly, it is an object of the present invention to provide a new and improved roll up hose system. A core has ends with an exterior surface. The core is adapted to receive a hose. End plates are mounted with respect to the ends of the core for constraining a hose on the core. A crank is coupled to the core. The crank is adapted to be grasped by a user and rotated for coiling a hose onto the core. A squeezing assembly is formed of an upper roller and a lower roller. The squeezing assembly is mounted for vertical movement with springs. The springs urge the rollers toward each other. In this manner a hose passes between the rollers while being coiled up on the core and will have liquid removed there from.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
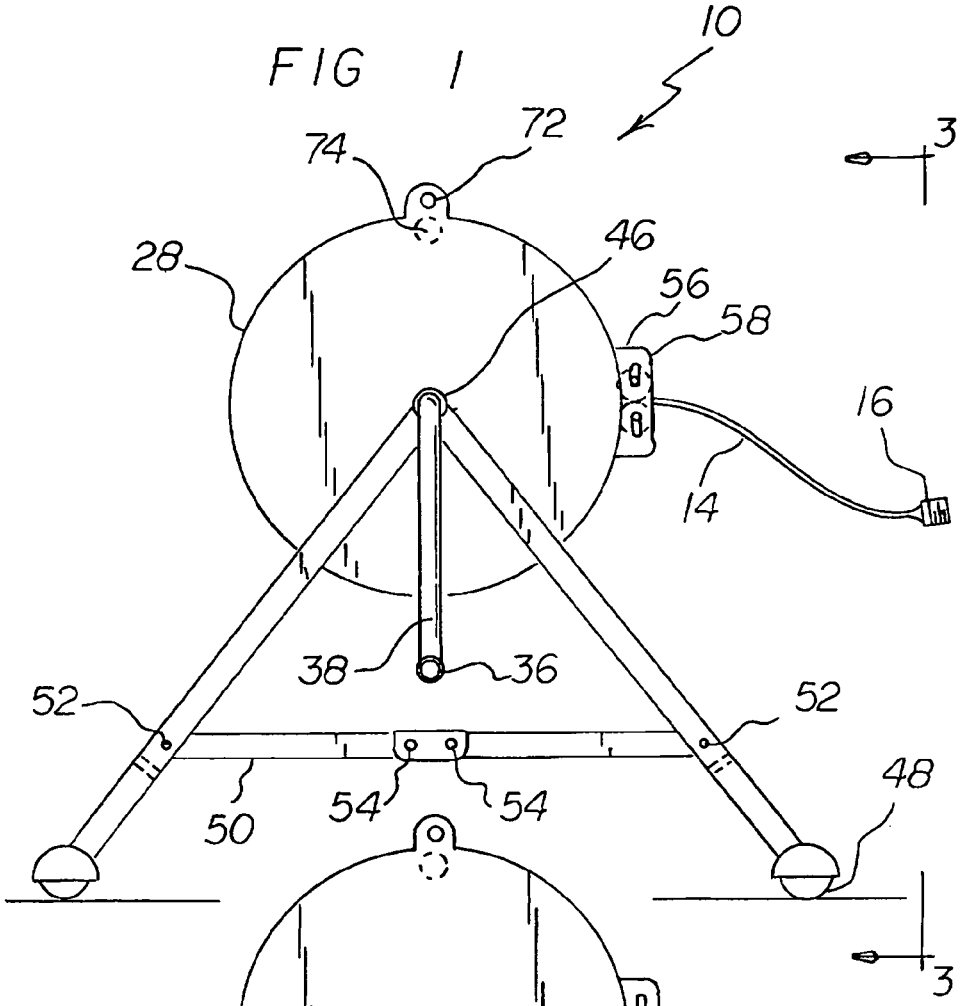
FIG. 1 is a side elevational view of a roll up hose system constructed in accordance with the principles of the present invention, the system being illustrated in a deployed orientation.
Figure 2:
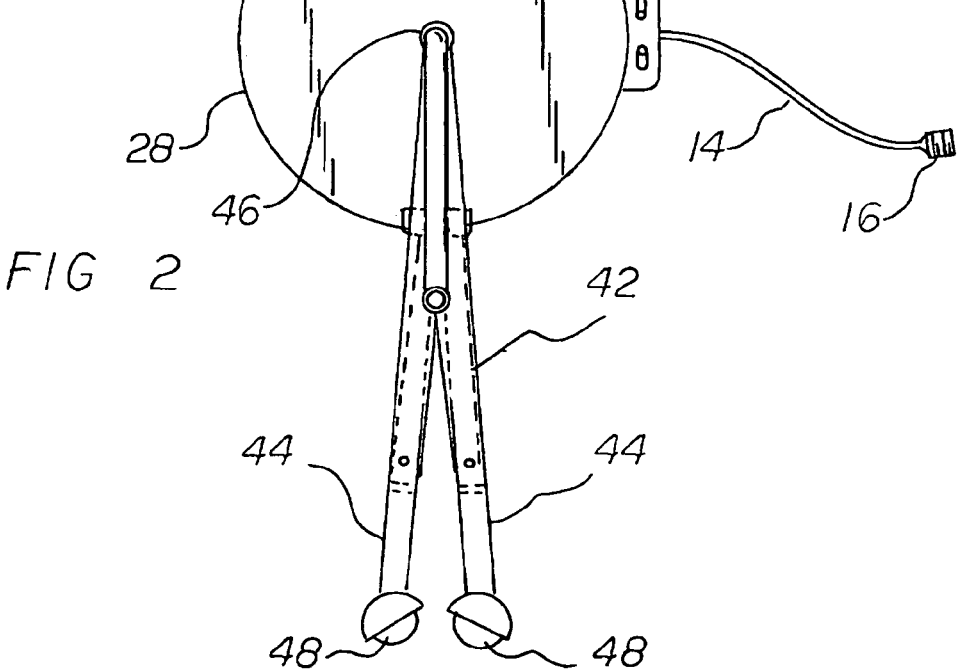
FIG. 2 is a side elevational view of the roll up hose system shown in FIG. 1, the system being illustrated in a stored orientation.
Figure 3:
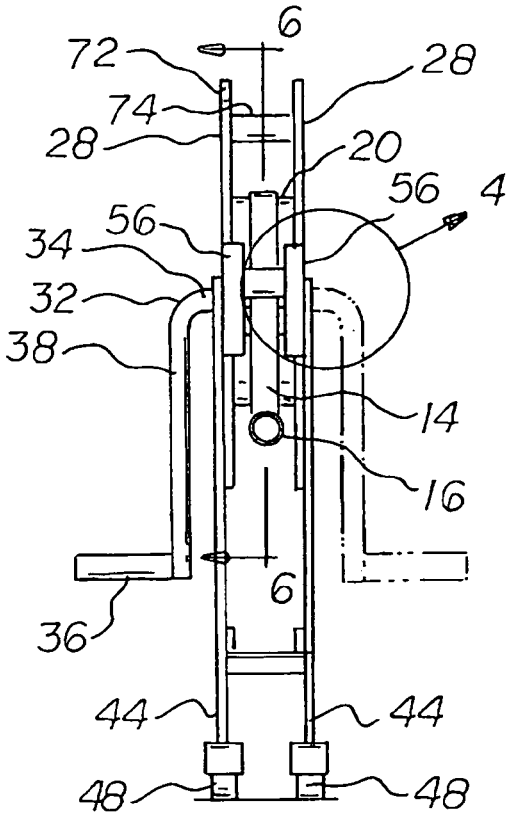
FIG. 3 is a front elevational view of the system taken along line 3—3 of FIG. 1.
Figure 4:
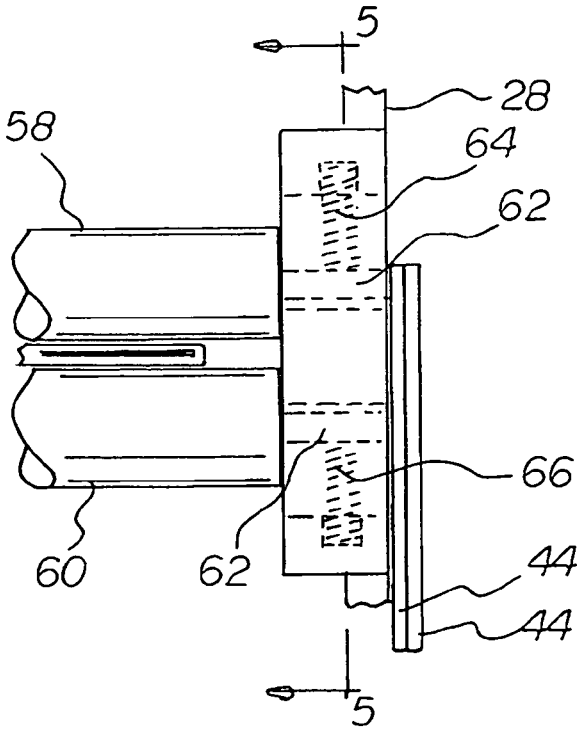
FIG. 4 is an enlarged view of a portion of the system taken at circle 4 of FIG. 3.
Figure 5:
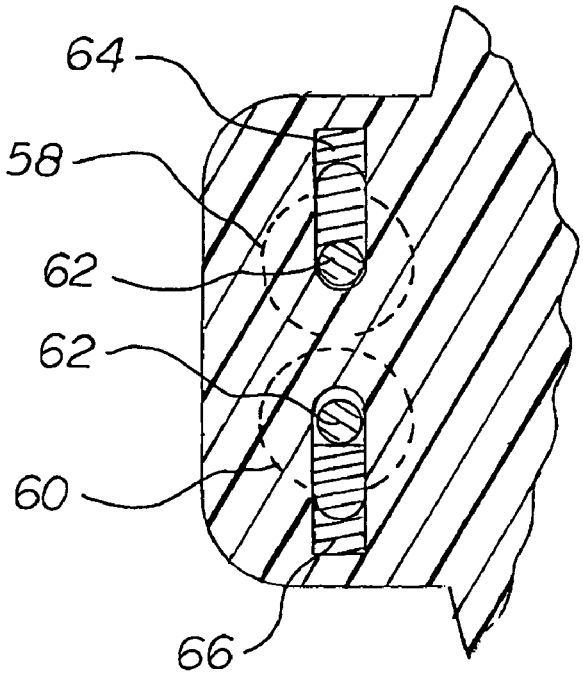
FIG. 5 is a cross sectional view taken at line 5—5 of FIG. 4.
Figure 6:
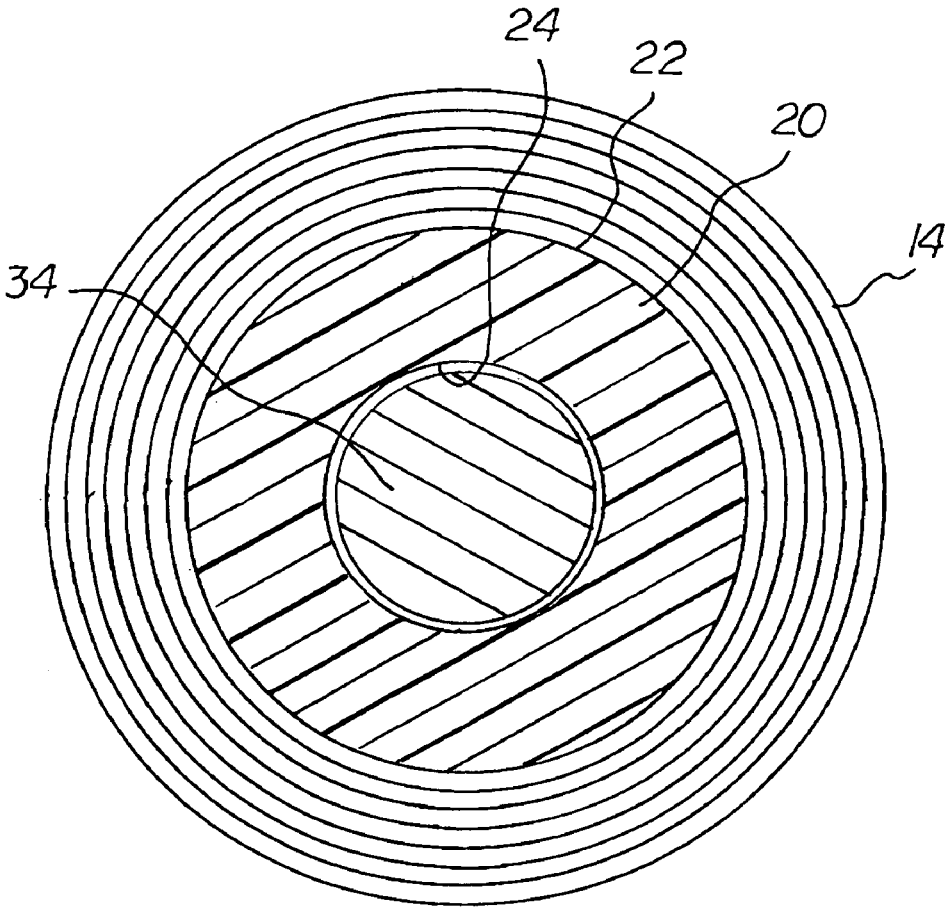
FIG. 6 is a cross sectional view taken at line 6—6 of FIG. 3.

With reference now to the drawings, and in particular to FIG. 1 thereof, the preferred embodiment of the new and improved roll up hose system embodying the principles and concepts of the present invention and generally designated by the reference numeral 10 will be described.

The present invention, the roll up hose system 10 is comprised of a plurality of components. Such components in their broadest context include a core, end plates, a crank and a squeezing assembly. Such components are individually configured and correlated with respect to each other so as to attain the desired objective.

First provided is aplastic hose 14. The plastic hose has an interior end and an exterior end. The plastic hose has a fitting 16. The hose is adapted to take on a cylindrical cross sectional configuration during use. A liquid moves through the plastic hose. The hose is adapted to take on a flat configuration during non-use and storage. The plastic hose has a common circumference along its length.

A rotatable cylindrical core 20 is provided. The cylindrical core has axial ends. The cylindrical core has an axial length provided between the axial ends. The cylindrical core has a cylindrical exterior surface 22. The exterior surface is adapted to receive thereon the interior end of the hose. In this manner the hose may be coiled around the cylindrical core and be dispensed from the cylindrical core by pulling the fitting. The cylindrical core has a cylindrical bore 24. The axial length of the cylindrical core is essentially equal to the circumference of the hose plus or minus 50 percent.

Provided next are circular end plates 28. The end plates are fixedly mounted with respect to the cylindrical core. In this manner the hose is constrained on the core. The exterior surface of the core has a diameter of between about 25 percent and 75 percent of the diameter of the end plates.

A crank 32 is provided. The crank has a horizontal interior section 34. The interior section extends through the end plates. The interior section is further secured to the cylindrical core for concurrent rotation with respect to the end plates. The crank also has a horizontal exterior section 36. The exterior section is adapted to be grasped by a user and rotated. In this manner a hose is coiled onto the core. The crank also has an intermediate section 38. The intermediate section couples the interior section and the exterior section.

Provided next is a leg assembly 42. The leg assembly is formed of four similarly configured legs 44. Each leg has an upper end with an aperture 46. The aperture receives the interior section of the crank. The leg assembly is formed of two legs on each side of the cylindrical core and end plates. Each leg has a lower end with wheels 48. The wheels facilitate rolling movement of the system. The leg assembly also includes a cross piece 50. The cross piece is provided on each side of the cylindrical core. The cross pieces each have ends 52. The ends are pivotally attached to two legs. The leg assembly further includes a central pivot 54. The central pivot allows the legs to move between essentially parallel orientations for storage and extended orientations during use.

Further provided is a squeezing assembly. The squeezing assembly is formed of two support plates 56. The support plates extend radially outwardly from the end plates. The support plates are laterally offset from the central axis of the cylindrical core with vertically spaced rollers. The squeezing assembly is also formed with an upper roller 58 and a lower roller 60. The rollers are rotatably received in the support plates. Each roller has a support shaft 62. The squeezing assembly also includes springs 64, 66. The support shaft is supported in the support plates for vertical movement with the springs. In this manner the upper roller is urged downwardly and the lower roller upwardly. Further in this manner a hose passes between the rollers while being coiled up on the cylindrical core and remove liquid from the hose.

Provided last are handling components. The handling components include an aperture 70. The aperture is provided in an upper extent of the support plates. The aperture facilitates hanging the system during storage. The handling components include a cross bar 72. The cross bar is provided between the end plates immediately beneath the aperture. The cross bar facilitates handling the system during relocation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A roll up hose system comprising:

a core having ends with an exterior surface adapted to receive a hose;

end plates mounted with respect to the ends of the core for constraining a hose on the core;

a crank coupled to the core and adapted to be grasped by a user and rotated for coiling a hose onto the core; and a squeezing assembly formed of an upper roller and a lower roller mounted for vertical movement with springs urging the rollers toward each other whereby a hose passing between the rollers while being coiled up on the core will have liquid removed there from; and a leg assembly formed of four similarly configured legs, each leg having an upper end with an aperture for receiving an interior section of the crank, two legs on each side of the core and end plates, each leg having a lower end with wheels to facilitate rolling movement of the system, the leg assembly also including a cross piece on each side of the core, the cross pieces each having ends pivotally attached to two legs and a central pivot to allow the legs to move between essentially parallel orientations for storage and extended orientations during use.

2. A roll up hose system for the coiling and uncoiling flat hose and for facilitating the storage and deployment of the system comprising, in combination:

a plastic hose having an interior end and an exterior end with a fitting, the hose adapted to take on a cylindrical cross sectional configuration during use with a liquid moving there through and a flat configuration during non-use and storage, the plastic hose having a common circumference along its length;

a rotatable cylindrical core having axial ends with an axial length there between and with a cylindrical exterior surface adapted to receive thereon the interior end of the hose to be coiled there around and to be dispensed therefrom by pulling the fitting, the core having a cylindrical bore, the axial length of the cylindrical core being essentially equal to the circumference of the hose plus or minus 50 percent;

circular end plates fixedly mounted with respect to the cylindrical core for constraining a hose on the core, the exterior surface of the core having a diameter of between about 25 percent and 75 percent of the diameter of the end plates;

a crank having a horizontal interior section extending through the end plates and secured to the cylindrical core for concurrent rotation with respect to the end plates, the crank also having a horizontal exterior section adapted to be grasped by a user and rotated for coiling a hose onto the core, the crank also having an intermediate section coupling the interior section and the exterior section;

a leg assembly formed of four similarly configured legs, each leg having an upper end with an aperture for receiving the interior section of the crank, two legs on each side of the cylindrical core and end plates, each leg having a lower end with wheels to facilitate rolling movement of the system, the leg assembly also including a cross piece 50 on each side of the cylindrical core, the cross pieces each having ends pivotally attached to two legs and a central pivot to allow the legs to move between essentially parallel orientations for storage and extended orientations during use;

a squeezing assembly formed of two support plates extending radially outwardly from the end plates laterally offset from the central axis of the cylindrical core with vertically spaced rollers, an upper roller and a lower roller, the rollers being rotatably received in the support plates, each roller having a support shaft supported in the support plates for vertical movement with springs urging the upper roller downwardly and the lower roller upwardly whereby a hose passing between the rollers while being coiled up on the cylindrical core and have liquid removed there from; and handling components including an aperture in an upper extent of the support plates to facilitate hanging the system during storage and a cross bar between the end plates immediately beneath the aperture to facilitate handling the system during relocation.

* * * * *